United States Patent [19]

Nakahata et al.

[11] 4,136,942

[45] Jan. 30, 1979

[54] ELECTROPHOTOGRAPHIC APPARATUS

[75] Inventors: Kimio Nakahata; Yasuyuki Tamura, both of Kawasaki, Japan

[73] Assignee: Canon Kabushiki Kaisha, Tokyo, Japan

[21] Appl. No.: 743,499

[22] Filed: Nov. 19, 1976

[30] Foreign Application Priority Data

Nov. 25, 1975 [JP] Japan ..... 50-141703

[51] Int. Cl.[2] ..... G03G 15/00

[52] U.S. Cl. ..... 355/3 CH; 355/14

[58] Field of Search ..... 355/3 CH, 14, 15; 361/235

[56] References Cited

U.S. PATENT DOCUMENTS

| | | | |
|---|---|---|---|
| 3,647,293 | 3/1972 | Queener | 355/15 |
| 3,714,531 | 1/1973 | Takahashi | 361/235 X |
| 3,775,104 | 11/1973 | Matsumoto et al. | 361/235 X |
| 3,778,148 | 12/1973 | Fwitsuka et al. | 355/15 |
| 3,871,081 | 3/1975 | Inoue et al. | 355/15 X |
| 4,003,651 | 1/1977 | Hashida et al. | 355/15 X |

*Primary Examiner*—William M. Shoop

*Attorney, Agent, or Firm*—Fitzpatrick, Cella, Harper & Scinto

[57] ABSTRACT

An electrophotographic apparatus constructed with a photosensitive body, a primary charger to apply a substantially uniform primary charge to the photosensitive body, a secondary corona discharger to apply to the photoconductive body either an AC corona discharge or a corona discharge of an opposite polarity to that of the primary charge so as to form an electrostatic latent image on the photosensitive body, the secondary corona discharge application being effected substantially simultaneously with irradiation of an image to be reproduced, wherein the secondary corona discharger is provided with a device to control discharge conditions.

19 Claims, 12 Drawing Figures

ELECTROPHOTOGRAPHIC APPARATUS

BACKGROUND OF THE INVENTION a. Field of the Invention

This invention relates to an electrophotographic apparatus. More particularly, the invention is concerned with the electrophotographic apparatus of a construction which uses a photosensitive body of a three-layer structure having an insulating layer on its surface to be repetitively used, and which is effective in preventing non-uniform electric charge remaining on the photosensitive body after its use from adversely affecting the subsequent reproduction operation.

b. Description of the Prior Art

In the above-described type of the electrophotographic apparatus which has so far been used, it is a common practice that a plurality of electric chargers for corona discharge are provided around a photosensitive body in a generally cylindrical or belt-shape (hereinafter referred to simply as "photosensitive layer"), and that latent image formation, image transfer, and related operations are carried out by changing over between a charged state and a stopped state in synchronism with the operation of the apparatus. In such apparatus, the surface potential of the photosensitive layer is in most cases non-uniform immediately after completion of operation of the charger, so that, when the photosensitive layer is left for a long period of time in this state, there inevitably takes place adverse effects, as is well known, such as the non-uniformity of images reproduced during subsequent operations of the apparatus. In order to avoid such an undesirable effect, the electric charge on the photosensitive layer may be discharged by irradiation of light onto the entire surface of the photosensitive layer as has already been known in the xerographic method as disclosed in, for example, U.S. Pat. No. 2,297,691, wherein the photosensitive layer provided on the surface of the electrically conductive body thereof with a photoconductive insulating material is used.

However, such light irradiation onto the photosensitive layer does, by itself, in no way, work to completely remove the electric charge in the electrophotographic method as disclosed in Japanese Patent Publication No. 42-23910, wherein the photosensitive layer of a three-layer structure composed of a substrate, a photoconductive layer, and an insulating layer is used. In this electrophotographic method, an electrostatic latent image may be formed on the surface insulating layer of the photosensitive layer due to the difference in the surface charge density by first uniformly charging the photosensitive layer disposed on the surface of a metal cylinder (hereinafter referred to as "photosensitive drum ") by a primary electric charger (when the photoconductive layer is made of p-type semiconductor, the polarity is negative (−)), then removing the charge by an AC corona discharger impressed with an alternating current voltage with simultaneous irradiation of an original image, and subsequently subjecting the entire surface of the photosensitive layer to a uniform exposure by means of an overall exposure lamp to cause a difference in the surface potential to occur in accordance with the brightness of the original image to be reproduced, thereby obtaining an electrostatic latent image having a high image contrast. Thereafter, toner is adhered onto the latent image by means of a developing device to form a visible image on the photosensitive layer, and the visible image is transferred by a corona charger onto a transfer paper fed to a predetermined position through a paper feed guide, and the paper which has completed the image transfer is separated and sent to an image fixing device. On the other hand, the photosensitive layer which has completed the image transfer is subjected to a cleaning operation to remove the toner remaining on the surface of the photosensitive layer. After this cleaning operation, the electric charge on the photosensitive layer is rendered uniform by means of an AC corona discharger for subsequent use, while it is being subjected to exposure by a small electric bulb. In this type of electrophotographic apparatus, the photosensitive layer is generally in a state of its having been charged extremely non-uniformly right after completion of a series of operations, and leaving the apparatus in this state would cause adverse effects in the subsequent reproduction operation.

To avoid such disadvantage, there has so far been known such a method that the operations of the primary charger and the image transfer charger are stopped, and, while irradiating light onto the photosensitive layer by the overall exposure lamp, the AC corona discharger is operated, and, apart from the process for the image reproduction, the photosensitive drum is rotated to carry out discharge of the photosensitive layer. In this case, however, when the discharge is performed with AC corona, the electric potential of the photosensitive layer tends to assume the negative polarity (−). Also, from the fact that the corona for use in the simultaneous AC discharge and exposure should preferably be of an opposite polarity to that of the primary charge, the AC corona discharger is so designed in some cases that the polarity of the corona is emphatically made negative (−), when the primary charge is made the positive (+) polarity. In this case, if the discharge is carried out by the AC corona without applying the primary charge, the photosensitive layer becomes emphatically charged to the negative (−). It has been discovered as the result of experiments using the AC corona, the polarity of which is emphatically made the negative, the potential of the photosensitive layer reaches as much as −380 volts during a period of only a few revolutions of the photosensitive drum. When the photosensitive layer is made to have such low potential, the potential of the electrostatic latent image will also become uniformly lowered at the time of the subsequent reproduction operation with the consequence that images of good quality cannot be obtained in most cases. Further, when the electric charge on the photosensitive layer is to be made uniform by the electric charger other than the AC corona discharger, there takes place various problems such that, when the AC corona discharger stops its operations, the photosensitive layer which is interposed between the primary charger and the AC corona discharger and which has been subjected to the uniform primary charge passes through the front of the developing device by the rotation of the photosensitive drum, at which time a large quantity of the developing agent adheres onto the surface of the photosensitive layer to contaminate the apparatus.

SUMMARY OF THE INVENTION

It is therefore the primary object of the present invention to provide an improved electrophotographic apparatus which is capable of removing the electric charge memory remaining on the photosensitive body after completion of the electrophotographic process.

It is another object of the present invention to provide the electrophotographic apparatus which is capable of correcting the non-uniform potential distribution on the surface of the photosensitive body.

It is a further object of the present invention to provide the improved electrophotographic apparatus which is capable of rendering the surface potential of the photosensitive body to be substantially zero, after completion of the electrophotographic process so as to stop operations of the apparatus.

It is yet another object of the present invention to provide the improved electrophotographic apparatus which is capable of rendering the surface potential of the photosensitive body, after completion of the electrophotographic process, to be uniform, so as to stop operations of the apparatus.

It is still another object of the present invention to provide the improved electrophotographic apparatus which is capable of varying the state of the corona discharge in the corona discharger to form the electrostatic latent image by the discharge action on the drum-shaped photosensitive body, after completion of the predetermined latent image formation, and of continuously rotating the drum, while the other corona dischargers stop their operations.

The foregoing objects, as well as the specific constructions, functions and resulting effects of the electrophotographic apparatus according to the present invention will become more apparent and understandable from the following detailed description of the preferred embodiments, when read in connection with the accompanying drawing.

DETAILED DESCRIPTION OF PREFERRED EMBODIMENT

Figure 1:
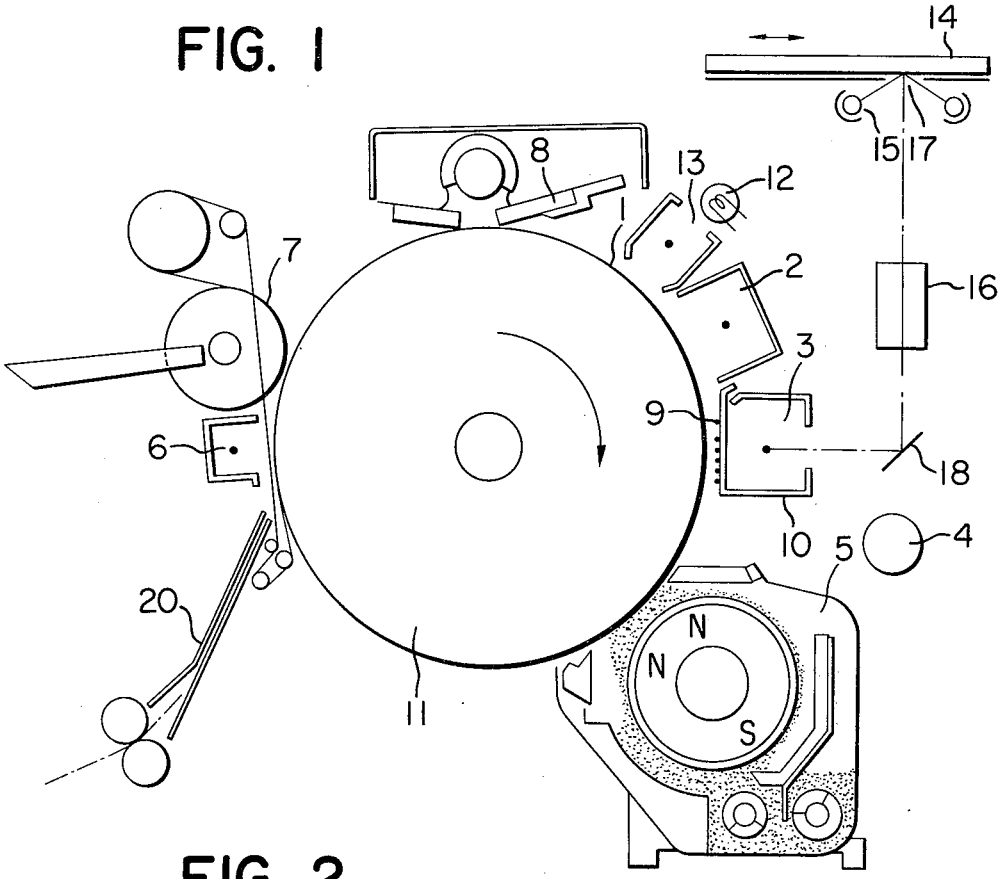
FIG. 1 is a schematic cross-sectional view of one embodiment of the electrophotographic apparatus, to which the present invention is applicable.

FIG. 1 shows one embodiment of the electrophotographic apparatus according to the present invention, wherein a photosensitive layer 1 provided on the surface of a metal cylinder 11 is uniformly charged to approximately +1,300 volts by means of a primary charger 2 (the polarity of which is negative (−) when the photoconductive layer is made of a p-type semiconductor), and subsequently subjected to discharge by means of an AC corona discharger 3 impressed with alternating current of approximately 7.6 kV, and to simultaneous irradiation of the original image by a halogen lamp 15 for exposure, whereby an electrostatic latent image is formed on a surface insulating layer of the photosensitive layer 1 due to a difference in the surface charge density. The original image is scanned by irradiation at the time of forward movement of an image holding table 14 through a slit 17, and an optical system 16, 18. Then, the entire surface of the photosensitive layer 1 is uniformly exposed by an overall exposure lamp 4 to cause a difference in the surface potential to occur, thereby forming the electrostatic latent image of high contrast. At this time, the photosensitive layer assumes the surface potential of +500 volts at the dark portion of the original image, and of −120 volts at the bright portion thereof. Subsequently, toner is adhered onto the latent image by means of a developing device 5 to form a visible image on the photosensitive layer 1, after which the latent image is transferred onto a transfer sheet or paper fed through a paper feeding guide by means of a corona charger 6 which has been applied with approximately +6.5 kV. The paper, on which the image transfer has been completed, is separated by a separating unit 7 and forwarded to an image fixing device. On the other hand, the photosensitive layer 1 which has completed the image transfer is cleaned by a blade cleaner 8 to remove the toner remaining on the surface thereof, and then, while being exposed by a small electric bulb 12, is subjected to discharge of the charge on the surface thereof immediately before the primary charger 2 by an AC corona discharger 13 so as to be useful for the subsequent reproduction operation.

After completion of a predetermined latent image formation by the AC corona discharger 3, if no latent image formation is continuously carried out thereafter, a voltage waveform to be applied to the AC corona discharger 3 is varied to reduce the negative component. And, after rotation of the drum for a certain predetermined time period, the primary charger 2 and the transfer charger 6 are stopped. Thereafter, the drum is continuously rotated, and the AC corona discharger 3 is stopped after one or more revolutions of the drum, whereby the surface charger of the photosensitive layer is removed to render the surface potential to be uniform.

Figure 2:
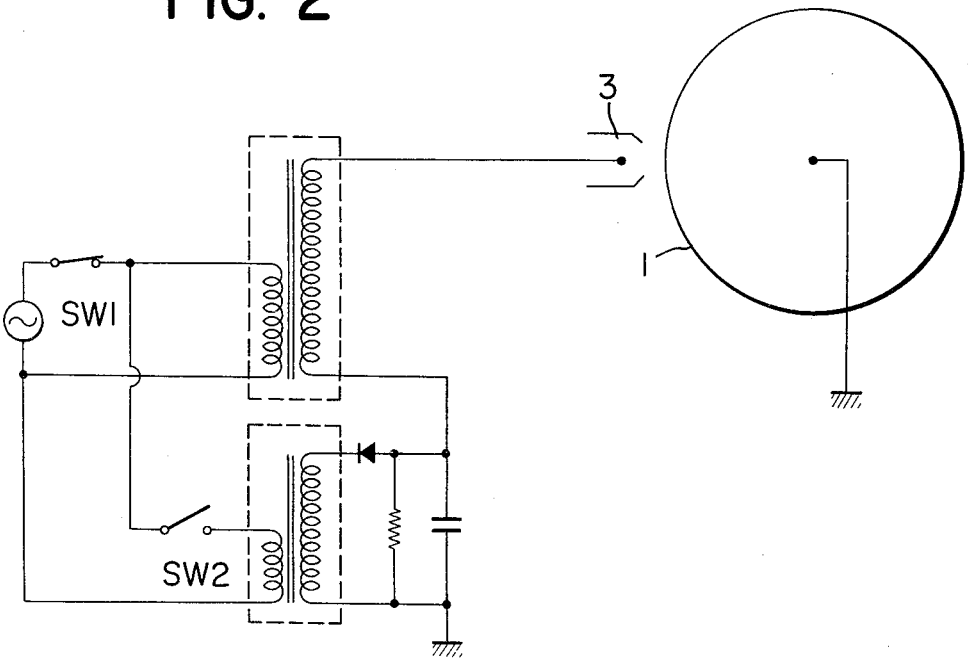
FIGS. 2–7 respectively illustrate embodiments of power source for the AC corona discharger in the electrophotographic apparatus according to the present invention.

FIG. 2 shows one embodiment of a method, wherein the voltage waveform to be applied to the AC corona discharger 3 is varied. That is, in the stage of the latent image formation, both switches $SW_1$ and $SW_2$ are brought to their closed state, and a voltage which emphasizes a corona discharge of an opposite polarity to that of the primary charge is applied to the AC corona discharger 3, as disclosed in Japanese Patent Publication No. 47-26911. Upon completion of the latent image formation, the switch $SW_2$ is opened, with the switch $SW_1$ being kept closed, and then the discharge of the photosensitive layer 1 is performed by eliminating the property of the AC corona discharger to emphasize the corona discharge of an opposite polarity to that of the primary charge, after which the switch $SW_1$ is opened to stop the discharge operation.

Figure 3:
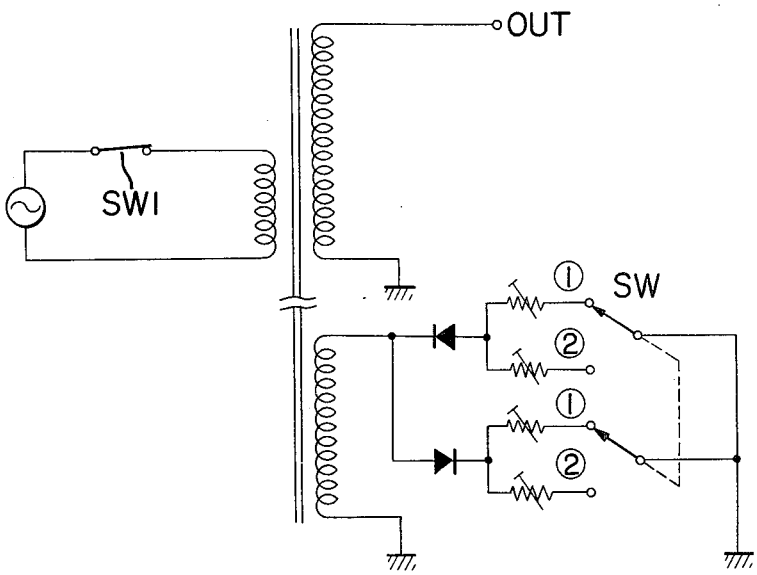

FIG. 3 indicates one embodiment of the circuit construction, wherein the control is possible with a low voltage. In this circuit, the switch $SW_1$ is closed during the latent image formation, and the switch $SW_2$ is connected to the side 1, whereby a voltage containing one strong component therein is applied to the corona discharger 3. After the latent image formation, the switch $SW_1$ remains as it is, while the switch $SW_2$ is switched over to the side 2, whereby tension of the voltage is lowered. The variations in the corona discharge current, at this time, should preferably be such that it changes from the components of −600 μA and +300 μA to the components of −500 μA and +400 μA, respectively, during the latent image formation. The voltage change-over in this circuit construction may range from 30 to 40 volts, since the output control from the output winding is conducted by varying a distortion in a waveform distortion circuit provided in the tertiary winding of a transformer, hence safety in operation can be secured, and the wear in the contact point can be reduced.

Figure 4:
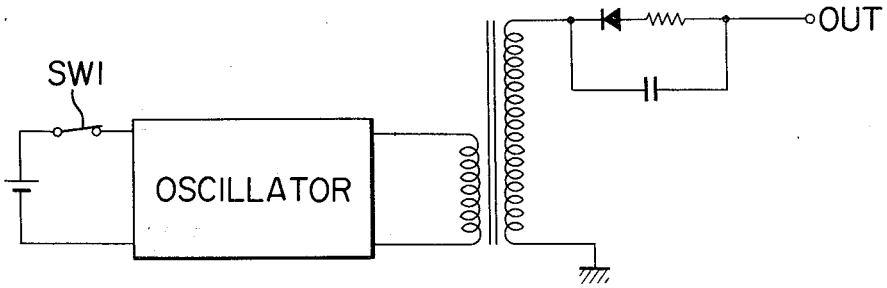
Figure 5:
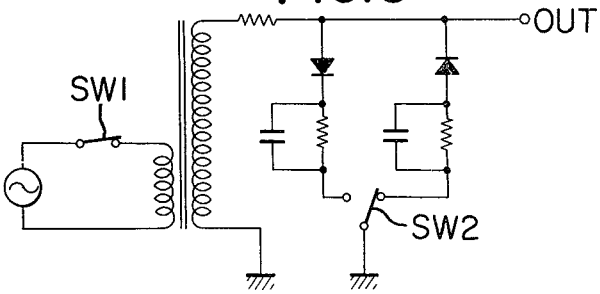
Figure 6:
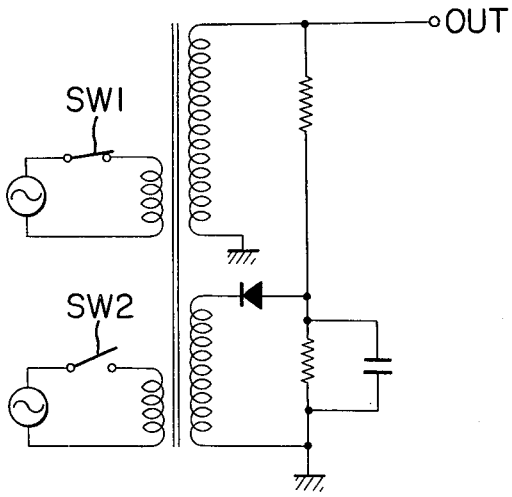
Figure 7:
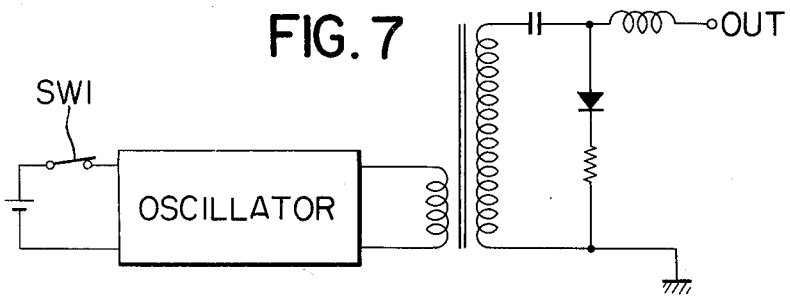

For the method of varying the voltage waveform to be applied to the AC corona discharger, there may be easily contemplated various circuits other than the abovementioned. According to the circuit shown in FIG. 4, the waveform can be varied by varying the oscillation frequency of an oscillator. Also, in FIGS. 5 and 6, the output waveform can be varied by changing over the switch $SW_2$, and, in FIG. 7, it is varied by changing the oscillation frequency of the oscillator.

For the method of changing the property of the AC corona discharger 3 to emphasize the corona discharge of an opposite polarity to that of the primary charge, there may be contemplated such methods as that (1) a bias voltage is applied to the grid 9 or shield member 10 of the AC corona discharger 3; (2) the voltage waveform to be applied to the AC corona discharger 3 is varied; and so on. Satisfactory result can also be obtained only by lowering the voltage to be applied to the AC corona discharger 3:

As the result of conducting experiments on the method, wherein the bias voltage is applied to the grid 9 of the corona discharger 3, it has been found that, when the bias voltage of the same polarity as that of the primary charge is applied, the property of the AC corona discharger 3 to emphasize the corona discharge in the opposite polarity to that of the primary charge is perfectly offset, and the surface potential of the photosensitive layer 1 can be substantially uniform, and be maintained at 0 volts or in that vicinity. Mere lowering of the voltage to be applied to the AC corona discharger 3 does not serve to vary its property to emphasize the corona discharge in the opposite polarity to that of the primary charge, although the entire surface of the photosensitive layer 1 can be made relatively uniformly at approximately 0 volts, since the discharge speed becomes retarded. In adopting this method, if the discharge is continued even after the surface potential of the photosensitive layer 1 becomes approximately 0 volts, the photosensitive layer 1 is charged to an opposite polarity to that of the primary charge due to the property of the AC corona discharger 3 to emphasize the corona discharge of the opposite polarity to that of the primary charge. Accordingly, when the surface of the photosensitive layer 1 has been properly discharged, such discharge operation should be immediately stopped. The foregoing change-over operation is also possible by a control, wherein a desired discharged conditions is made to be gradually obtained.

Figure 8:
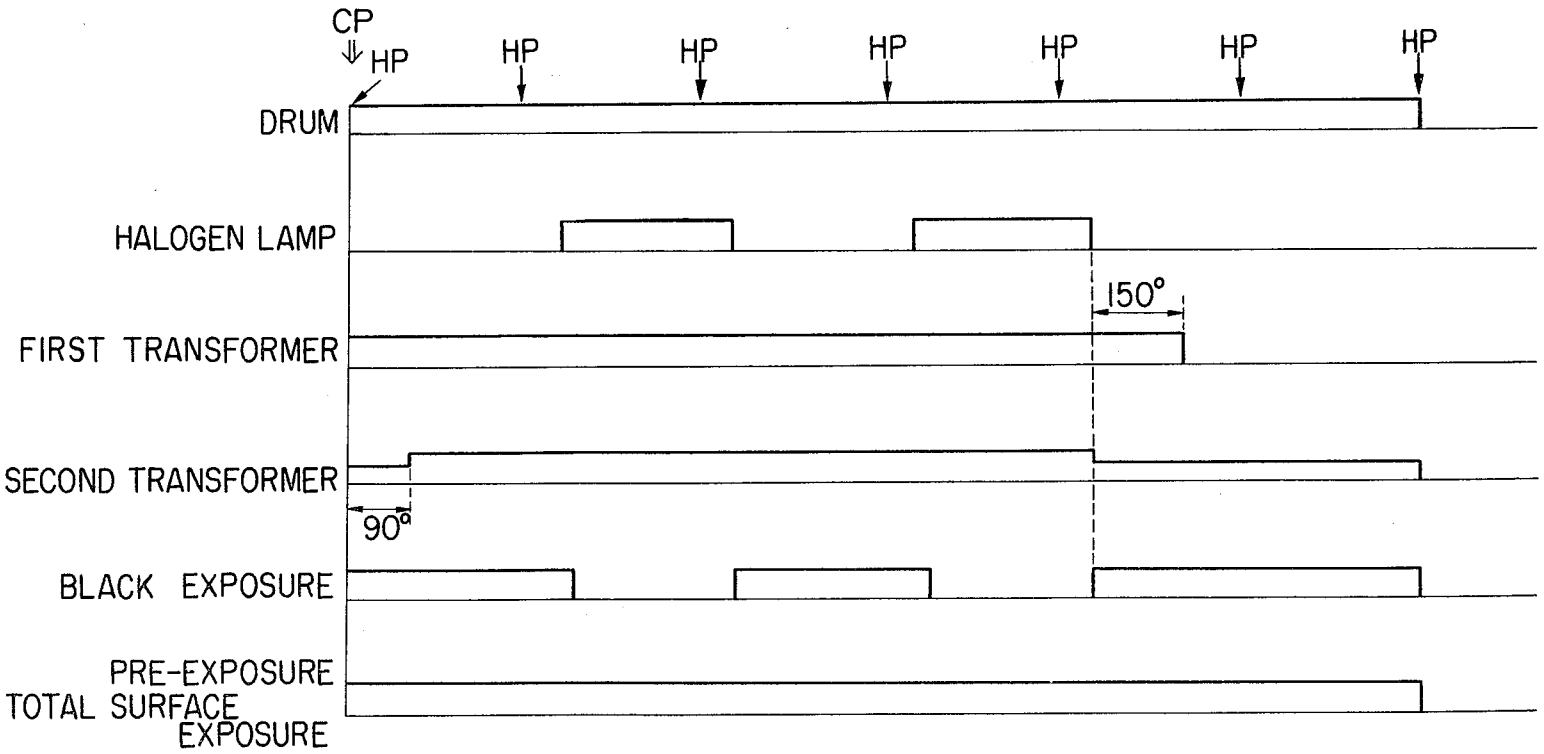
FIG. 8 is a diagram showing one embodiment of the operational sequence of the apparatus according to the present invention.

The change-over timing of the AC corona discharger will now be described hereinbelow in reference to FIG. 8.

The output of the first transformer is connected to the primary charger 2, the transfer charger 6, and the AC corona discharger 13. The output of the second transformer is connected to the AC corona discharger 3. By the term "blank exposure" is meant an exposure which is simultaneously given to the photosensitive layer 1 along with the alternating current corona discharge effected by the AC corona discharger so as to prevent unnecessary developing material from adhering onto the photosensitive layer 1.

In respect of the time lapse from an instance when the corona discharge in the AC corona discharger 3 in the opposite polarity to that of the primary charge has been varied, up to an instance when the primary charge and the transfer charge are stopped, although it may be possible to vary the property of the AC corona discharger to emphasize the corona discharge in the opposite polarity to that of the primary charge with simultaneous stoppage of the primary charge and the transfer charge, it will be more preferable that the primary charge and the transfer charge are stopped after the photosensitive drum 11 has rotated for a rotational angle greater than at least an angle between the AC corona discharger 3 and the transfer charger 6 subsequent to variation in the property of the AC corona discharger to emphasize the corona discharge in the opposite polarity to that of the primary charge.

The reason for this will be described in the following. In general, when a positive image is to be obtained by adhering a toner onto a portion corresponding to the dark portion of the original image, the toner to be used will be charged in a polarity opposite to that of the primary charge, and the transfer charge will be of the same polarity as that of the primary charge. In this case, when the primary charge in the electrophotographic apparatus as shown in FIG. 1 is made positive (+), for example, the portion on the photosensitive layer 1 where the surface potential is the lowest after completion of the usual latent image formation is between the AC corona discharger 3 and the transfer charger 6. Accordingly, when the potential of the photosensitive layer surface is to be made uniform, the property of the AC corona discharger 3 to emphasize the corona discharge in the opposite polarity to that of the primary charge is varied in advance, and, after the surface potential between the AC corona discharger 3 and the transfer charger 6 is made slightly higher, both primary charge and transfer charge are stopped, whereby the converging potential difference on the photosensitive drum surface upon completion of the rotational sequence becomes accordingly small, since the potential difference on the photosensitive drum surface becomes smaller. In either case as mentioned in the foregoing, stoppage of the transfer charge should apparently take place subsequent to passage of the transfer paper in front of the transfer charger 6.

Figure 9:
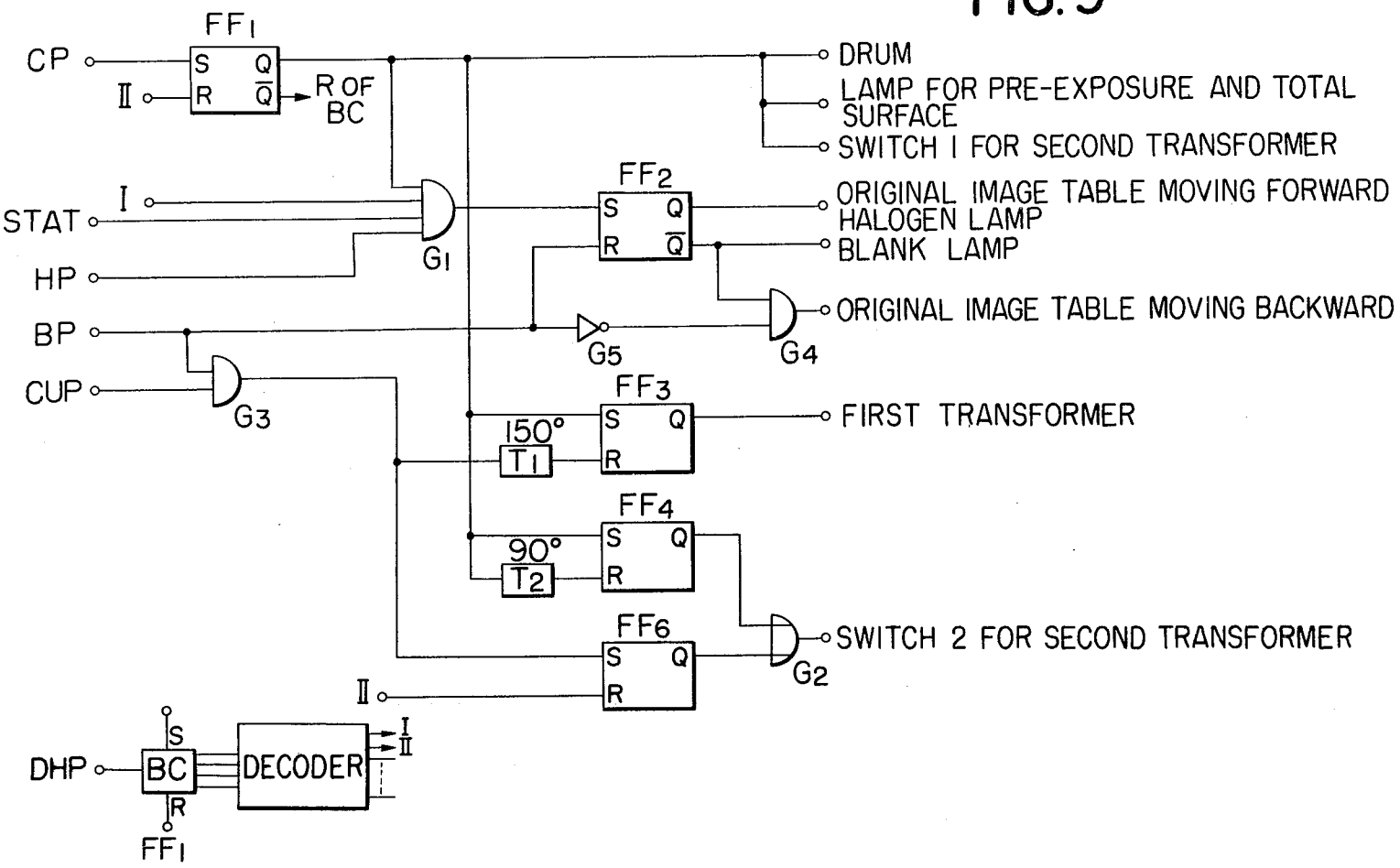
FIG. 9 shows one embodiment of the timing control circuit for the operational sequence shown in FIG. 8.

One embodiment of such timing control is shown in FIG. 9. In this embodimental circuit construction, a reference symbol "CP" denotes a copy start signal by depression of a reproduction button. "DHP" denotes a drum home position signal which indicates that the photosensitive drum arrives at a particular position, which signal is detected by a cam provided on the drum as well as at a position where a seam of the photosensitive body and the blade cleaner 8 meet each other. "CUP" refers to a count-up signal to show the last sheet of the paper to be fed out of a stack of the reproduction sheets of a predetermined number. "HP" designates a home position signal which indicates that the original image holding table is at an ordinary position. "BP" indicates a back position signal which shows that the image holding table is at a position to commence its return motion. Both home position signal and back position signal are generated by a cam provided on the image holding table and a micro-switch on the main body of the apparatus. $FF_1$ to $FF_6$ designate flip-flop circuits which are set by a leading edge of a pulse signal to a terminal S to produce an output step signal (1) from a terminal Q and an output signal (O) from a terminal Q, and are reset by a leading edge of a pulse signal to a terminal R to invert the outputs. $G_1$, $G_3$, and $G_4$ are respectively "AND" gates; $G_2$ refers to "OR" gate; and $G_5$ designates an inverter. "BC" denotes a known binary counter to count the DHP signal, which produces a 1-count signal I and a 2-count II by means of a decoder. This binary counter, when the count signal I is used, is set by the CP signal; and when the count signal II is used, is set by the output from the "AND" gate $G_3$, and reset by the output from the terminal Q of the flip-flop $FF_1$. $T_1$ designates a timer to delay an input signal by a rotational angle $\pi°$ of the photosensitive drum, and $T_2$ refers to another timer to delay an input signal by a rotational angle 150° of the photosensitive drum. "STAT" denotes a starting signal for forwarding the image holding table, which is obtained from the cam provided on the photosensitive drum, the signal being generated with some delay from DHP signal. The signal is for eliminating the DHP signal from the image area. It is also possible to provide further corona dischargers having the above-mentioned discharging conditions in any appropriate area between the developing device 5 and the primary charger 2, and to operate the further corona dischargers by stopping an output from the discharge 3 in place of changing over its output.

Incidentally, in the photosensitive layer of a three-layer structure consisting of a substrate, a photoconductive layer, and an insulating layer, it is not adequate to say that an electric field becomes instantaneously non-existent, even when the surface potential of the photosensitive layer becomes substantially 0 volts. In other words, there might be such a case that the surface potential is substantially 0 volts due to offsetting of the field due to electrons or holes existing in the photoconductive layer and the field due to the charge existing in the photosensitive layer surface. If the photosensitive layer is left for a long period of time in such state, there is a high possibility that undesirable effects would occur at the subsequent reproduction operation. With a view to avoiding such undesirable situation, measurements have heretofore been taken in the electrophotographic apparatus of a type as shown in FIG. 1 such that, while the discharging operation is being conducted on the photosensitive layer by means of the AC corona discharger, the overall exposure lamp 4 is turned on to expose the photosensitive layer, to liberate the electrons or holes existing in the photoconductive layer, and to thereby produce a state where no electric field exists in at least the photoconductive layer. Even in this case, however, when the operation of the AC discharger 10 is stopped and the overall exposure lamp 4 is turned off simultaneously, the electrons or holes in the photoconductive layer of the photosensitive layer positioned, at that time, in front of the AC corona discharger 3 are not liberated, but cause adverse effects to the field existing in the photoconductive layer. To avoid this, exposure operation may be conducted simultaneously at the time of conducting the discharge by means of the AC corona discharger 3, although it is virtually difficult to sufficiently expose the entire portion of the photosensitive layer. For giving sufficient light on all portions of the photosensitive layer, it is desirable that the photosensitive drum 11 be rotated after stoppage of the discharge operation by the AC corona discharger to such an extent that at least the portion of the photosensitive layer 1 which is positioned in front of the AC corona discharger 3 may be exposed, while the overall exposure lamp 4 is being turned on.

Figure 10:
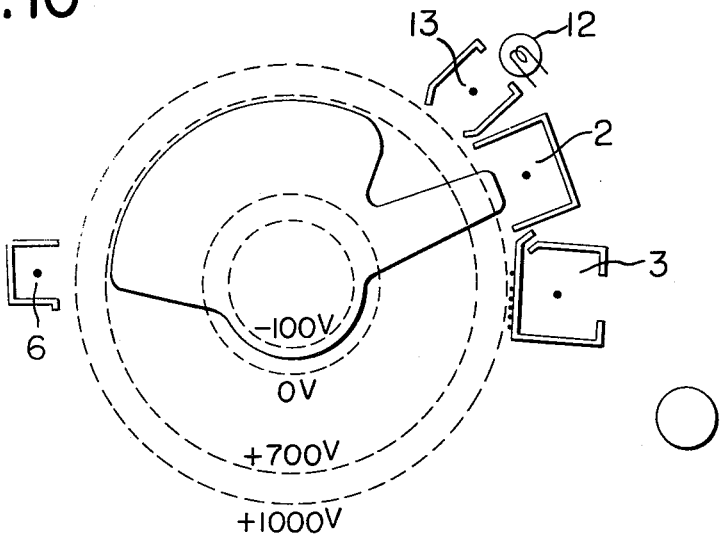
FIGS. 10–12 respectively show the surface potential on the photosensitive layer, when the electrophotographic apparatus as shown in FIG. 1 is operated.
Figure 11:
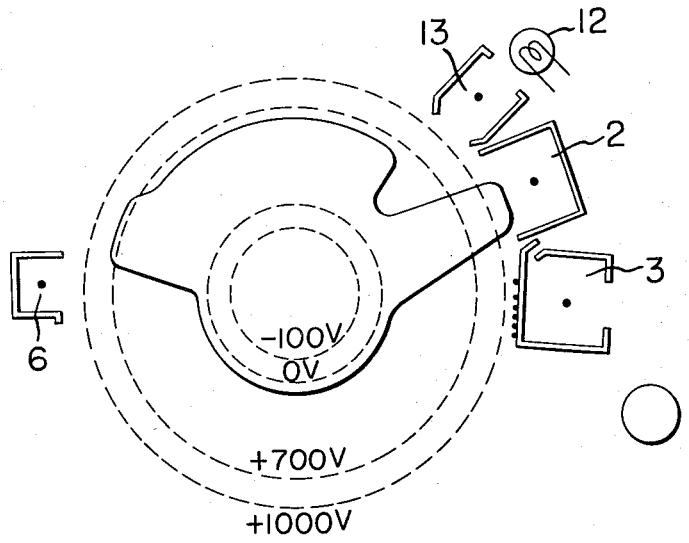
Figure 12:
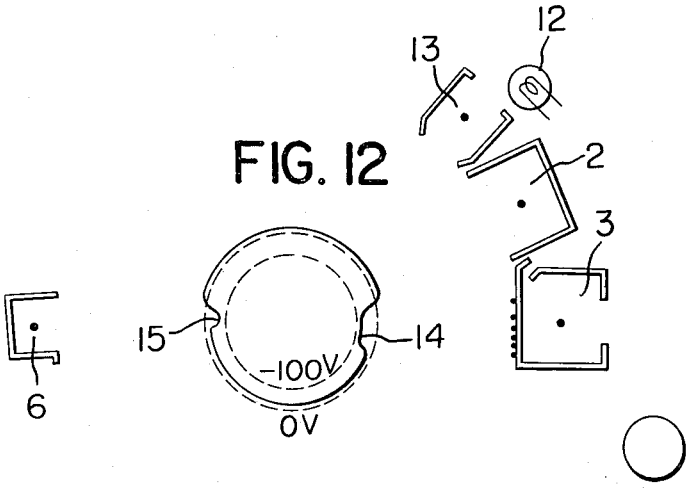

FIGS. 10–12 indicate embodiments of the surface potential on the photosensitive layer 1 when the electrophotographic apparatus as shown in FIG. 1 is operated in accordance with the present invention.

FIG. 10 shows the surface potential right after the latent image formation. In this case, the surface potential at the portion between the AC corona discharger 3 and the transfer charger 6 is not constant, because it is a latent image of the original to be reproduced. The drawing shows the surface potential corresponding to the bright portion of the original image.

FIG. 11 shows the surface potential of the photosensitive layer upon completion of the transfer of a visible image by means of the transfer charger 6. Since, at this time, the output from the AC corona discharger 3 has already reduced its effect to charge the photosensitive layer in a polarity opposite to that of the primary charge, the potential between the AC corona discharger 3 and the transfer charger 6 is at a few tens of volts in the positive polarity.

FIG. 12 shows the surface potential of the photosensitive layer after it has been rendered uniform by the AC corona discharger 3. The portion 14 where the surface potential is −100 volts or so has been twice applied with the corona discharge by the AC corona discharger 3, where the effect of the AC corona discharger 3 to charge the photosensitive layer in the opposite polarity to that of the primary charge has not yet been satisfactorily eliminated, hence it is charged to the negative polarity. With a further improved apparatus, the surface potential at this point may be rendered substantially 0 volts.

The portion 15 where the surface potential is −70 volts or so has been subjected to the discharge operation by the charger 13 to render the electric charge in the photosensitive layer to be uniform, and the portion where the surface potential has been lowered in advance is applied with the corona discharge by the AC corona discharger 3 and charged in the negative polarity. Accordingly, the surface potential at this point may be rendered substantially 0 volts, if the effect of the AC corona discharger 3 to charge the photosensitive layer in the opposite polarity to that of the primary charge.

What we claim is:

1. An electrophotographic apparatus, comprising:

(a) a three-layer photosensitive medium having an insulating layer, a photoconductive layer, and an electrically conductive substract;

(b) means for applying a substantially uniform primary charge of a predetermined polarity to said photosensitive medium;

(c) means for applying a secondary charge to said photosensitive medium by a corona discharger having a polarity component opposite to that of said primary charge;

(d) means for irradiating said photosensitive member with a light image to be reproduced, said primary charge means, secondary charge means and irradiating means being operable to form an electrostatic latent image on said photosensitive medium; and (e) means for controlling said secondary charge means to change the discharging power thereof after completion of said electrostatic latent image formation.

2. An electrophotographic apparatus as claimed in claim 1, further comprising means for imparting substantially uniform light onto the surface of said photosensitive medium after completion of said electrostatic latent image formation.

3. An electrophotographic apparatus as claimed in claim 1, further comprising means for stopping operation of said primary charge means subsequent to said change in discharging power of said secondary charge means.

4. An electrophotographic apparatus as claimed in claim 3, wherein said photosensitive medium is rotatable during said latent image forming operation, and said control means is effective to terminate operation of said second charge means after said photosensitive medium rotates through at least one full turn subsequent to the controlling operation of said control means.

5. An electrophotographic apparatus as claimed in claim 4, wherein said control means includes means for automatically terminating the operation of said secondary charge means after the one-full rotation of said photosensitive medium.

6. An electrophotographic apparatus as claimed in claim 1, wherein said control means controls a wave form of a power supplied to the secondary charging means.

7. An electrophotographic apparatus as claimed in claim 6, wherein said control means is effective to decrease a component in said wave form.

8. An electrophotographic apparatus comprising:

(a) a rotatable photosensitive medium;

(b) means for forming an electrostatic latent image on said rotatable medium, said latent image forming means including corona discharger means;

(c) means for developing the electrostatic latent image to form a developed image on said photosensitive medium;

(d) means for transferring the developed image onto a transfer medium;

(e) means for continuously rotating said rotatable photosensitive medium to provide a preset number of developed images for transfer onto transfer materials;

(f) control means for operation after transfer of the preset number of the latent images to apply a current wave form to said corona discharger means, to cause the surface potential of said photosensitive medium to approach zero.

9. An electrophotographic apparatus as claimed in claim 8, wherein said corona discharger is an AC corona discharger means, and said control means operates to decrease a component of the current wave form applied to the discharger means.

10. An electrophotographic apparatus as claimed in claim 8, wherein said corona discharger means includes a primary corona discharger, and an AC corona discharger operative simultaneously with image light application to said photosensitive medium; and wherein said control means operates to decrease a component of an AC current wave form applied to said AC corona discharger.

11. An electrophotographic apparatus as claimed in claim 8, wherein said control means includes means for terminating operation of said corona discharger means after said photosensitive medium rotates through at least one full turn subsequent to the operation of said control means.

12. An electrophotographic apparatus comprising:

(a) a rotatable photosensitive medium;

(b) means for forming an electrostatic latent image on said rotatable photosensitive medium, said latent image forming means including corona discharging means for applying a primary charge to said rotatable photosensitive medium and means for removing the primary charge from said photosensitive medium in accordance with a pattern of an image to be reproduced;

(c) means for developing the electrostatic latent image formed by said latent image forming means, to form a developed image;

(d) means for tranferring the developed image onto a transfer material;

(e) means, having an AC corona discharger and disposed in facing relation with said rotatable photosensitive medium, for causing a surface potential of said rotatable photosensitive medium to approach zero, after completion of latent image formation; and (f) means for terminating operation of said AC corona discharger after said rotatable photosensitive medium rotates through one full turn subsequent to the operation of said AC discharger for causing said surface potential to approach zero.

13. An electrophotographic apparatus as claimed in claim 12, wherein said primary charge removing means and said means for causing said surface potential to approach zero comprise a single AC corona discharger and means for applying different current wave forms to said AC discharger, respectively, when it is effective as said primary charge removing means and as said means for causing said surface potential of zero.

14. An electrophotographic apparatus comprising:

(a) a rotatable photosensitive medium;

(b) means for forming an electrostatic latent image on said rotatable photosensitive medium, said latent image forming means including corona discharging means for applying a primary charge to said rotatable photosensitive medium and means for removing the primary charge from said photosensitive medium in accordance with a pattern of an image to be reproduced;

(c) means for developing the electrostatic latent image formed by said latent image forming means, to form a developed image;

(d) means for transferring the developed image onto a transfer material;

(e) means for rotating said rotatable photosensitive-medium and for stopping it after a predetermined time period;

(f) AC corona discharge means for discharging said rotatable photosensitive medium to remove a charge therefrom, and to stop the discharging operation before said rotatable medium is stopped; and (g) means for exposing said rotatable medium during the rotation thereof after the developed image has been transferred, and continuing, for a particular time period, the exposing operation after the discharging operation of said AC corona discharger has been stopped.

15. An electrophotographic apparatus according to claim 14, wherein said AC corona discharger discharges the polarity component which is opposite to the polarity of said first mentioned corona discharger more strongly than its other component.

16. An electrophotographic apparatus according to claim 14, wherein said photosensitive medium includes an insulating layer, a photoconductive layer and a conductive layer, and said AC corona discharger also functions as said removing means, said exposing means applying uniform light to said photosensitive medium after the primary charge is removed from said photosensitive medium in accordance with a pattern of an image to be reproduced.

17. An electrophotographic apparatus according to claim 4, further comprising, means for exposing said rotatable medium during the rotation thereof after operation of said control means, and continuing, for a predetermined time period, the exposing operation after the discharging operation of said secondary corona discharger has been stopped.

18. An electrophotographic apparatus according to claim 8, wherein said corona discharge means stops its operation before the rotation of said photosensitive medium is stopped, and further comprising means for exposing said rotatable medium during the rotation thereof after the developed image has been transferred, and continuing, for a predetermined time period, the exposing operation after the operation of said corona discharge means has been stopped.

19. An electrophotographic apparatus according to claim 12, wherein said corona discharge means stops its operation before the rotation of said photosensitive medium is stopped, and further comprising means for exposing said rotatable medium during the rotation thereof after the developed image has been transferred, and continuing, for a predetermined time period, the exposing operation after the operation of said corona discharge means has been stopped.

* * * * *

UNITED STATES PATENT OFFICE

CERTIFICATE OF CORRECTION

Patent No. 4,136,942 Dated January 30, 1979

Inventor(s) KIMIO NAKAHATA, ET AL

It is certified that error appears in the above-identified patent and that said Letters Patent are hereby corrected as shown below:

Column 3, line 28, after "objects," insert --other objects,--;

Column 7, line 5, change "Q," (second occurrence) to --$\overline{Q}$,--;

Column 7, line 15, change "Q" to --$\overline{Q}$--;

Column 7, line 17, change "$\pi$°" to --90°--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*